US005887874A

United States Patent [19]

Goldfarb et al.

[11] Patent Number: 5,887,874

[45] Date of Patent: Mar. 30, 1999

[54] GAME WITH ACTION DISCHARGE

[75] Inventors: Adolph E. Goldfarb, 1432 Eastwind Cir., Westlake Village, Calif. 91361; Martin I. Goldfarb, Santa Monica, Calif.

[73] Assignee: Adolph E. Goldfarb, Northridge, Calif.

[21] Appl. No.: 108,579

[22] Filed: Jul. 1, 1998

Related U.S. Application Data

[60] Division of Ser. No. 944,079, Oct. 4, 1997, Pat. No. 5,823,538, which is a continuation-in-part of Ser. No. 796,713, Feb. 6, 1997, Pat. No. 5,704,610.

[51] Int. Cl.[6] ..... A63B 71/00

[52] U.S. Cl. ..... 273/455; 273/457; 273/460; 273/440

[58] Field of Search ..... 273/454, 455, 273/440, 441, 445, 447, 457, 459, 460

[56] References Cited

U.S. PATENT DOCUMENTS

| | | | |
|---|---|---|---|
| 3,333,846 | 8/1967 | Glass et al. | 273/455 X |
| 3,547,436 | 12/1970 | Breslow | 273/455 |
| 4,039,184 | 8/1977 | Breslow et al. | 273/455 X |
| 4,673,181 | 6/1987 | Baran et al. | 273/455 X |
| 5,263,714 | 11/1993 | Rudell et al. | 273/457 X |
| 5,470,082 | 11/1995 | Clayton | 273/445 |
| 5,678,825 | 10/1997 | Clayton | 273/445 |

*Primary Examiner*—Raleigh W. Chiu
*Attorney, Agent, or Firm*—Ashen & Lippman

[57] ABSTRACT

In one form of the game, the player must maintain her face in position to be sprayed while using a tool to capture or manipulate a visually observed object. This game may include an open electrical circuit that mishandling of the tool causes to close to direct a spray at the player.

18 Claims, 1 Drawing Sheet

GAME WITH ACTION DISCHARGE

RELATED APPLICATIONS

This application is a Divisional of U.S. application Ser. No. 08/944,079 filed Oct. 4, 1997, now U.S. Pat. No. 5,823,538, which is a Continuation-In-Part of U.S. application Ser. No. 08/796,713 filed Feb. 6, 1997, and is now U.S. Pat. No. 5,704,610.

FIELD OF THE INVENTION

Games having a physical action component directed at the players.

BACKGROUND OF INVENTION

Children love competitive action games that involve a degree of suspense and excitement. Often in such games, at some point an action occurs such as a light going on or a siren going off or something falling down. Children also enjoy participating in and causing the action and/or trying to prevent the action. There is further play value in having to react or do something once the action takes place.

SUMMARY OF ILLUSTRATED APPARATUS EMBODYING THE PRESENT INVENTION

The drawings illustrate several forms of the invention.

In one form, the game apparatus is so constructed and arranged as to require a desired portion of the player's body such as her face to be maintained in a player location or area in order for her to effectively play the game. At times dictated by the play of the game, the liquid or other discharge is directed to that player area and thus at the player. In this form of the game the player tries to capture or manipulate visually observable displays which may be in the form of small discrete objects. In one version, the player manipulates a capturing tool to connect to and withdraw objects through small openings. The tool forms a first electrical contact and the edges of the openings form second electrical contacts. If the tool engages an opening edge, an electrical circuit is completed and a liquid discharge is directed toward the player's face in the player area.

IN THE DRAWINGS

DETAILED DESCRIPTION OF THE DRAWINGS

Embodiments of FIGS. 1 through 6

Figure 3:
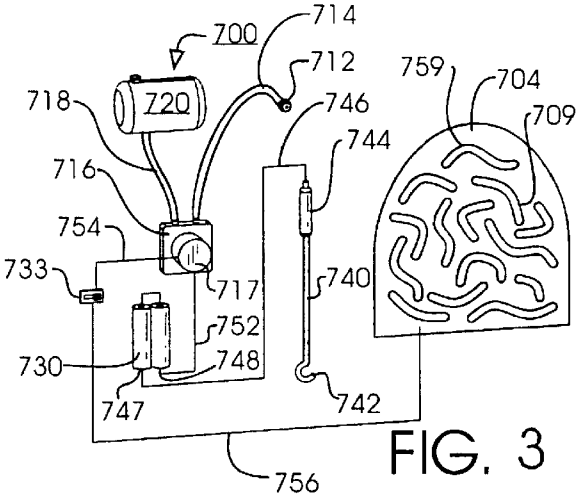
FIG. 3 is a schematic diagrammatic illustration of various components of the game apparatus of FIG. 1.
Figure 2:
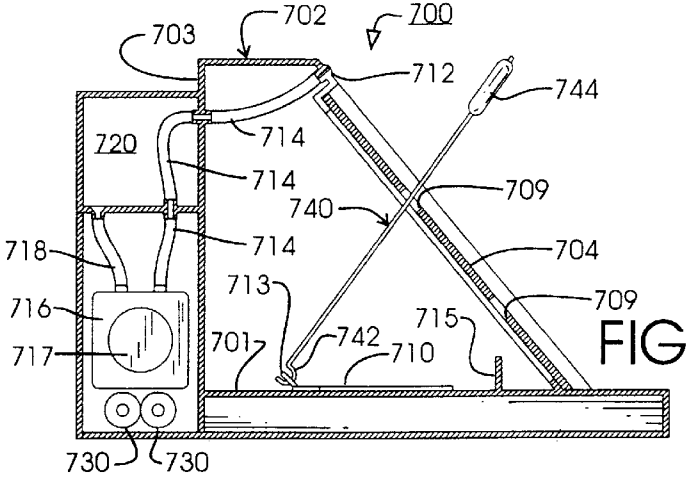
FIG. 2 is a side sectional view of the game apparatus of FIG. 1.
Figure 1:
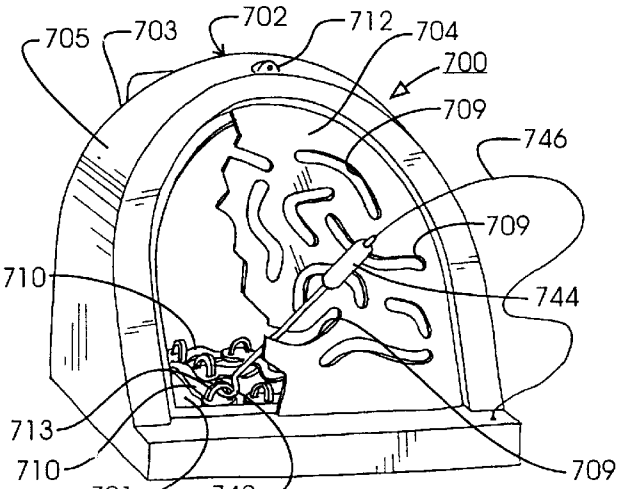
FIG. 1 is a perspective view, with sections broken away, of one game apparatus which embodies a presently preferred form of the invention.

FIGS. 1 through 3 illustrate game apparatus 700 which embodies a presently preferred form of the invention. Game apparatus 700 includes a housing 702 that has a front wall or face 704. Front wall 704 has a plurality of openings or entrances 709 that extend through the wall. A plurality of visually observable displays in the form of discrete objects 710 are disposed a substantial distance from the rear side of the front wall 704. An elongated capturing or manipulating tool or rod 740 is used by the player to extend through one of the entrance openings 709 to engage and pick up one of the display objects 710. The illustrated rod 740 has a first connection means 742 at its outer end for releasibly connecting to second connecting means 713 on the object. Because of the substantial distance between the opening and the object, the player cannot position herself off to the side and still see the object and the rod end sufficiently to engage the connecting means 713, 742 to connect the rod to the object. Rather, to have adequate visibility to so engage the rod with the object, the player must position her head so that her line of sight is through the opening and aligned with the object to be captured. This positions the player's head in the desired player area. A liquid discharge nozzle 712 is mounted on the housing 702 to direct a liquid discharge at that player area.

To ensure sufficient minimum distance between objects 710 and openings 709 that will require the player to position her head in the player area, a short upright transversely extending wall or barrier 715 may be provided across the forward portion of the housing bottom wall 701. This barrier 715 maintains the objects a minimum distance from the closest opening. A minimum distance of about 1.5" provides the desired results.

The rod 740 may be metal so as to provide or act as a first electrical contact. The entrance openings 709 may have edges that are at least in part metal to provide or act as a second electrical contact. The rod 740 and the opening edges may be connected to suitable electrical wiring that lead to and form an electrical circuit with a set of dry cell batteries 730 and a pump motor 717. Whenever the metal rod 740 engages a metal contact edge portion of an entrance opening 709, the circuit is completed and the motor 717 is energized to power a pump 716 to discharge a liquid discharge from the nozzle 712 toward the player area.

In the play with apparatus 700, the player aligns her sight with one of the entrance openings 709 and one of the display objects 710. She then inserts the capture rod 740 through that opening 709 and toward that object 710. She attempts to engage the connection means on the rod with the connection means on one of the objects and then to with draw the object that through that opening. If at any time the metal rod 740 engages a contact portion of the opening edge 707, the circuit will be completed and the player will receive a liquid discharge from the nozzle 712.

More particularly, the illustrated game housing 702 has a bottom wall 701, a rear wall 703, the front wall or face 704, and a curved intermediate wall 705 which provides a top and sides to the housing. The rear wall 703 is generally upright, while the front wall or face 704 is tilted or incline back from the vertical about 30 degrees. Rear compartments are attached to the rear wall 703 to provide a closed water tank section 720 and an area for the motor 717, pump 716 and batteries 730. The illustrated front wall 704 is made of electrically conductive material such as sheet metal.

Figure 5:
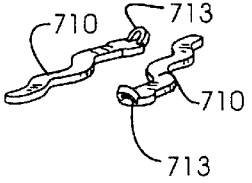
FIG. 5 is an enlarged perspective view of two play objects of the game apparatus of FIG. 1.

The illustrated entrance openings 709 in the front wall 704 have various different shapes, as do the illustrated objects 710. Two of the objects 710 are illustrated in FIG. 5. It is only necessary that, for each object 710, there is at least one opening 709 that is sized and shaped to allow passage of that object through the opening. Alternatively, all of the objects 710 may have the same single size and shape, for simplicity and low cost. Similarly, all of the openings 709 could be the same single size and shape.

The illustrated display objects 710 are shown randomly dispose on the housing bottom wall 701. Such randomness may be achieved by placing all of the objects within the housing and shaking the housing. It would also be possible to eliminate the bottom wall 701 and allow the objects to the randomly dispose on a supporting surface such as a table or the floor. Each of the display objects 710 is provided with a first connection means such as an eyelet 713 for connecting to the rod 740.

The illustrated capture or pick-up rod 740 has a curved or hook portion 742 at its outer end that provides a second connection means for engaging and releasibly connecting to one of the objects 710 and lifting that object through a suitable opening 709. The metal rod 740 has an insulated hand grip 744 adjacent its other end. An electrical wire 746 is connected to that rod other end and to an electrical contact 747 that engages the batteries 730 (FIG. 3). A second electrical contact 748 to the batteries is connected by a suitable electrical wire 752 to the motor 717 that drives the pump 716. A further electrical wire 754 goes from the motor 717 to an off/on switch 733. Another electrical wire 756 then connects the switch 733 to the sheet metal front wall 704. The wall 704 has the openings 709. The edges of the openings 709 provide the electrical contact edge portions described above. Each illustrated opening 709 provides a continuous electrical contact edge portion that extends completely around that opening. Alternatively the electrical contact portions could be limited to only certain portions of the opening edge (not shown).

Whenever a player, while trying to capture and extract an object 710, allows the metal rod 740 to engage any portion of the electrical contact edge of an opening 709, the electrical circuit is completed and the motor 717 is energized to operate the pump 716 to cause a liquid discharge from the nozzle 712 toward the player head position at the player area.

In this connection, the pump 716 is connected to the nozzle by a conduit 714. The pump 716 is also connected to a tank section 720 by a conduit 718. The tank section 720 may have a suitable filling entrance (not shown).

The remainder of the housing 702 (other than the front wall 704) may be constructed of any suitable material such as molded plastic. It is desirable that the front wall 704 be opaque (or at least translucent) to require the player to look through an opening 709 to observe and monitor the engagement of the rod hook 742 with an eyelet 713 of a selected object 710. To allow the player to observe the interior of the housing, it is desirable that at least some of the remaining top side and/or rear walls be transparent or translucent so that light is admitted to that interior. Alternatively an interior light could provided (not shown). The front wall 704 may be detachable or openable to provide access to the interior of the housing 702.

Referring to FIG. 3, as soon as an electrical contact between the rod 740 and the opening edge 707 is ended, the circuit is broken and the pump 717 will immediately cease to deliver a liquid discharge.

Figure 4:
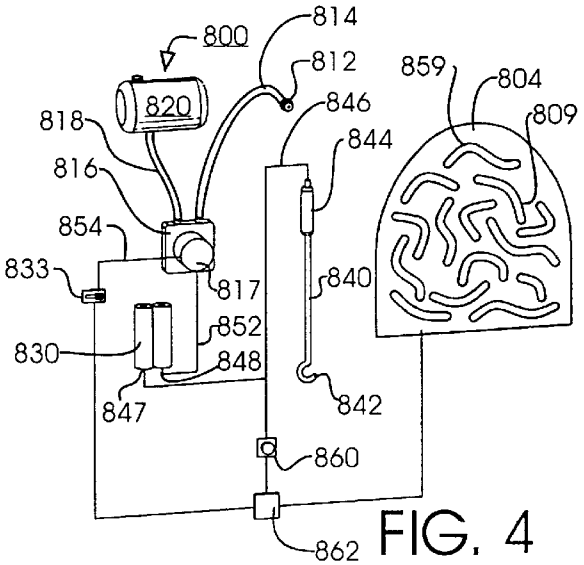
FIG. 4 is a schematic diagrammatic illustration of components of a modified form of the apparatus of FIG. 1.

FIG. 4 illustrates an alternative game apparatus 800 which is generally like apparatus 700. Comparable parts are in the 800 series instead of the 700 series. However, in game apparatus 800 the discharge continues until the player pushes a stop button 860. In this connection, apparatus 800 includes an SCR 862 and the stop button 860 in such an arrangement that whenever the circuit is completed, even momentarily, by engagement of the contacts 840, 809, the SCR will remain closed to maintain the completed circuit so that there is continued power to the motor 817. This in turn operates the pump 816 to cause the discharge from the nozzle 812 to continue. The player must press the stop button 860 to open the SCR and end power to the motor, which stops the liquid discharge. Alternatively, the SCR could be replaced with a time-delay circuit (not shown) so that the circuit to the motor would be broken only after a predetermined time delay (such as 0.5 second) after engagement has ended between the contacts 840, 809.

Figure 6:
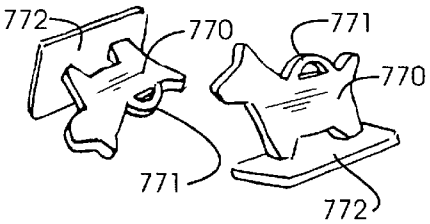
FIG. 6 is an enlarged view of an alternative form of object.

In another variation of the game, the tool 704 could be used to manipulate game objects inside the housing as, for example, by turning over or reorienting objects in accordance with game dictates or objectives. FIG. 6 shows an elongated object 770 that has an eyelet 771 at one end and a flat base 772 at the other end. The tool 740 could be extending through a contact opening and used to engage the eyelets 771 of the objects 770 and stand them upright without the tool engaging the opening electrical contact edges. Similarly, the objects could be stacked or separated into designated groups.

While a liquid discharge in the form of a spray is generally preferred, it may be appropriate for some uses to provide more of a single or multi-faceted stream from the nozzle, particularly when it is desired to reach a greater distance then might be achieved with a spray.

As used in this patent application, the terms "operation" and "movement" as applied to a game response element or part includes non-operation or non-movement as well. For example, a player's failure to respond in the time afforded could be the requisite "operation" or "movement" that causes or provides a discharge.

Various modifications and changes may be made in the illustrated without departing from the spirit and scope of the present invention as set forth in the following claims.

What is claimed is:

1. A game apparatus comprising:

a wall having a front side and a rear side and at least one opening there through, said opening having a peripheral edge at least a portion of which provides a first electrical contact, at least one visual display object disposed at least a sufficient distance from the rear side of said wall so that it is visible to a player of the game positioned at the front side of the wall and looking through said opening only when the eyes of the player are generally aligned with the opening and the object, the player's head being generally positioned in a player area, when her eyes are so aligned, a handling device for use by a player to extend through the opening, engage an object and manipulate that object, a second electrical contact on said handling device, electrical elements connected to said first and second contacts and to a source of electrical energy so as to complete a circuit whenever said second contact engages said first contact, a liquid discharging mechanism operable to direct a liquid discharge toward said player area, said discharging mechanism being operatively connected to said circuit elements so that whenever the circuit is completed, the discharge mechanism will provide such a discharge.

2. The game apparatus of claim 1 wherein there are a plurality of said openings and a plurality of said objects.

3. The game apparatus of claim 1 wherein the entire peripheral edge of said opening is an electrical contact.

4. The game apparatus of claim 1 wherein said wall is generally upright.

5. The game apparatus of claim 1 wherein said generally upright wall is tilted rearwardly from the horizontal.

6. The game apparatus of claim 1 wherein said wall is generally opaque.

7. The game apparatus of claim 6 wherein there are generally upright side wall portions generally surrounding the area at the rear of said wall where said objects are disposed and said side wall portions are generally transparent or translucent so as to admit light to the area where said objects are disposed.

8. The game apparatus of claim 1 wherein said handling device comprises an elongated rod of electrically conductive material.

9. The game apparatus of claim 1 wherein said liquid discharging mechanism includes a motor, a pump, a source of electrical energy and a discharge nozzle.

10. The game apparatus of claim 1 wherein the minimum distance from said opening to said object is about 1.5 inch.

11. The apparatus of claim 1 wherein said electrical elements includes an SCR and a player operable stop means, said elements being arranged so that, once the SCR is energized and closed, that SCR remains closed until it is opened by player operation of the stop means.

12. The game apparatus of claim 1 wherein the electrical elements include a time delay element for maintaining the circuit closed for a predetermined time period after disengagement between such first and second contacts.

13. The game apparatus of claim 1 wherein said handling device is releasibly connectable to said object for moving the object through the opening to the front side of the wall.

14. The game apparatus of claim 1 wherein said handling device engages said object so as to manipulate said object in the area at the rear side of said wall.

15. A game method comprising:

a) providing a wall having a front side and a rear side and at least one opening there through, said opening having a peripheral edge at least a portion of which provides a first electrical contact, b) providing at least one visual display object at the rear side of said wall, c) disposing said object at least a sufficient distance from the rear side of said wall so that it is visible to a player of the game positioned at the front side of the wall and looking through said opening only when the eyes of the player are generally aligned with the opening and the object, the player's head being generally positioned in a player area when her eyes are so aligned, d) providing a handling device with a second electrical contact thereon for use by a player, e) providing electrical elements connected to said first and second contacts and to a source of electrical energy so as to complete a circuit whenever said second contact engages said first contact, f) providing a liquid discharging mechanism operable to direct a liquid discharge toward said player area, said discharging mechanism being operatively connected to said circuit elements so that whenever the circuit is completed, the discharge mechanism will provide such a discharge, g) extending the handling device through the opening, h) engaging said object with the handling device and manipulating said object in accordance with an objective of the game.

16. The method of claim 15 wherein the manipulation all takes place at the rear side of said wall.

17. The method of claim 15 wherein the manipulation includes moving the object through the opening to the front side of said wall.

18. A game apparatus comprising:

a) at least one liquid discharging mechanism for directing a liquid discharge toward a player area where a player of the game associated with said game apparatus is positioned during play of the game and, b) game means operatively connected to the liquid discharging mechanism for causing the mechanism to discharge liquid toward said player area, said game means including a movable element, said element being selectively movable incident to play of the game between at least one actuating position and at least one not actuating position, movement of said element to an actuating position causing said game means to operate said mechanism to discharge, said game means including components of an electrical circuit including at least one electrical contact, said element also being a component of said electrical circuit, said actuating position of said element being one where it is in engagement with said electrical contact so as to complete said circuit.

* * * * *